United States Patent [19]

Clark et al.

[11] 3,968,548

[45] July 13, 1976

[54] LEAD TRANSFER MECHANISM

[75] Inventors: Donald George Clark, Instow; Ivan Godfrey Oliver Brown, Barnstaple, both of England

[73] Assignee: AMP Incorporated, Harrisburg, Pa.

[22] Filed: Dec. 16, 1974

[21] Appl. No.: 533,390

[52] U.S. Cl. ..... 29/33 M; 29/203 DT; 214/1 BD

[51] Int. Cl.[2] ..... B21F 15/00

[58] Field of Search ..... 29/33 M, 203 DT; 214/1 BD, 147 T

[56] References Cited

UNITED STATES PATENTS

| | | | |
|---|---|---|---|
| 2,954,599 | 10/1960 | Cootes et al. | 29/33 M |
| 3,653,412 | 4/1972 | Gudmestad | 29/33 M X |

*Primary Examiner*—Othell M. Simpson
*Assistant Examiner*—Z. R. Bilinsky
*Attorney, Agent, or Firm*—Gerald K. Kita

[57] ABSTRACT

A lead transfer mechanism for transferring a cut and stripped lead from a lead measuring, cutting, and stripping mechanism to a terminal applying applicator or the like. The lead transfer mechanism includes a conveyor arm, one end of which is swingable between a first position adjacent the cutting and stripping mechanism and a second position adjacent the applicator. The conveyor arm is caused to be moved by rotary cam means which is drivingly interconnected with the lead measuring, cutting, and stripping mechanism in such a manner that the rotary cam means will rotate one revolution for each measuring cycle of the measuring mechanism. The one end of the conveyor arm carries lead engaging means, and first shifting means is provided for shifting the lead engaging means from an open position to a closed position when the one end of the conveyor arm is in its first position. The lead transfer mechanism further includes means to dispose the first shifting means either in an operative or in an inoperative position, the disposing means being interconnected with the cutting and stripping mechanism to permit the lead engaging means to be shifted to the closed position only when the cutting and stripping means is in its operative position. Furthermore, the lead transfer mechanism also includes second shifting means operable to open the lead engaging means when in the second position, and ejector means mounted adjacent the applicator, the second shifting means and the means to control the ejector means including cam lobes mounted on the rotary cam means.

17 Claims, 8 Drawing Figures

LEAD TRANSFER MECHANISM

FIELD OF THE INVENTION

The present invention relates generally to a lead transfer mechanism, and more particularly to a lead transfer mechanism for transferring a lead of predetermined length having a cut and stripped end from a mechanism which measures, cuts and strips a lead to an applicator which applies terminations to a cut and stripped end of the lead.

BACKGROUND OF THE INVENTION

Machines are well-known in the art which measure a length of electrical lead wire, and cut and strip one or both ends of the lead wire after measuring. Applicator machines are also well-known in the art for applying a termination to the cut and stripped end of an electrical lead wire. In many industrial situations the cut and stripped leads of predetermined length are fed by hand to the applicator machine. When this approach is used, there are inherent production disadvantages based on the limitations of the skill of the operator of the applicator machine. Today these production disadvantages are being compounded by the requirement of guards on the machines which further reduce the productivity of the operator.

In the past, special purpose machines have been developed wherein cut and stripped leads of predetermined length are automatically conveyed to an applicator station. Examples of this prior art are shown in U.S. Pat. Nos. 3,267,556 and 3,653,412. These machines, which employ endless conveyor chains, while satisfactory for their intended purpose have the inherent disadvantages of being unduly complex. Furthermore, the complexity of these machines may cause these machines to have a higher breakdown rate that the simplified structure which incorporates the principles of this invention.

In U.K. Pat. No. 1,207,889, published Oct. 7, 1970, a machine is disclosed which strips the end of a previously cut electrical lead wire of predetermined length and then subsequently transfers it to an applicator station, this machine including a swingable arm which transfers the stripped lead to the applicator station. This machine has the disadvantage of being incapable of measuring and cutting a lead from a lead supply. It has the additional disadvantage in that the swinging of the arm is controlled by a pneumatic cylinder which does not give the precision required for a high speed operation.

OBJECTS AND SUMMARY OF THIS INVENTION

It is the principal object of the present invention to provide a lead transfer mechanism of simplified construction which is capable of a high rate of production, the lead transfer mechanism accurately transferring a cut and stripped lead from a mechanism which measures, cuts and strips the lead to an applicator which applies a termination to the end of the lead.

It is a further object of the present invention to provide a lead transfer mechanism which continuously cycles in response to the cycling of the lead measuring mechanism, means being provided whereby the lead transfer mechanism will not convey a lead until the completion of the cutting and stripping operation of the lead measuring, cutting, and stripping mechanism.

These and other objects and advantages of this invention are attained by mounting the lead transfer mechanism on a frame which also supports a lead measuring, cutting, and stripping mechanism and an applicator, the lead transfer mechanism including conveyor arm means, one end of which is swung between a first position adjacent lead measuring, cutting, and stripping mechanism and a second position adjacent the termination applicator by rotary cam means which insures the accurate placement of lead engaging means carried by one end of the conveyor arm means. The lead transfer mechanism further includes bell crank lever means pivotally mounted on the frame and operable to cause the lead engaging means, which is mounted on one end of the conveyor arm means, to be shifted between open and closed positions when the conveyor arm means is disposed in its first position. The bell crank lever means is caused to be operated by cam means which are supported by the rotary cam means, and the bell crank means is shifted between operable and inoperable positions by means which are interconnected with the cutting and stripping mechanism. The lead transfer mechanism also includes means to open the lead engaging means adjacent the applicator, and means to eject a terminated lead, the means to open the engaging means and the ejector means being operated by spaced apart cams which are also supported by the rotary means.

The objects set forth above and other objects and advantages of this invention will be apparent to those skilled in the art, after a consideration of the following detailed description, taken in conjunction with the accompanying drawings in which a preferred form of this invention is illustrated.

DESCRIPTION OF THE PREFERRED EMBODIMENT

Figure 1:
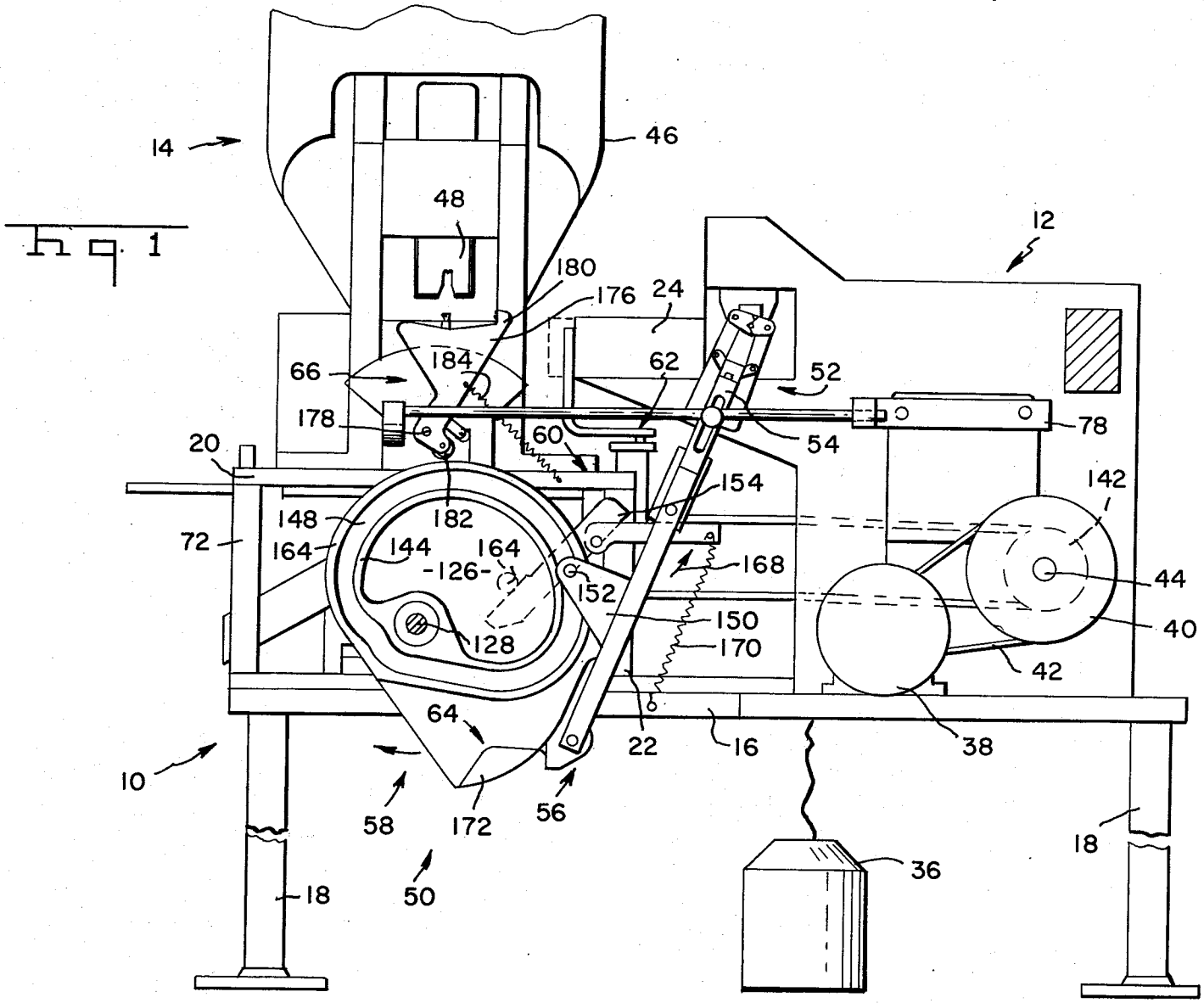
FIG. 1 is a side view of an apparatus in which the principles of this invention are incorporated, the lead engaging means carried by one end of the conveyor arm means being shown in its first position adjacent a lead measuring, cutting, and stripping mechanism.
Figure 2:
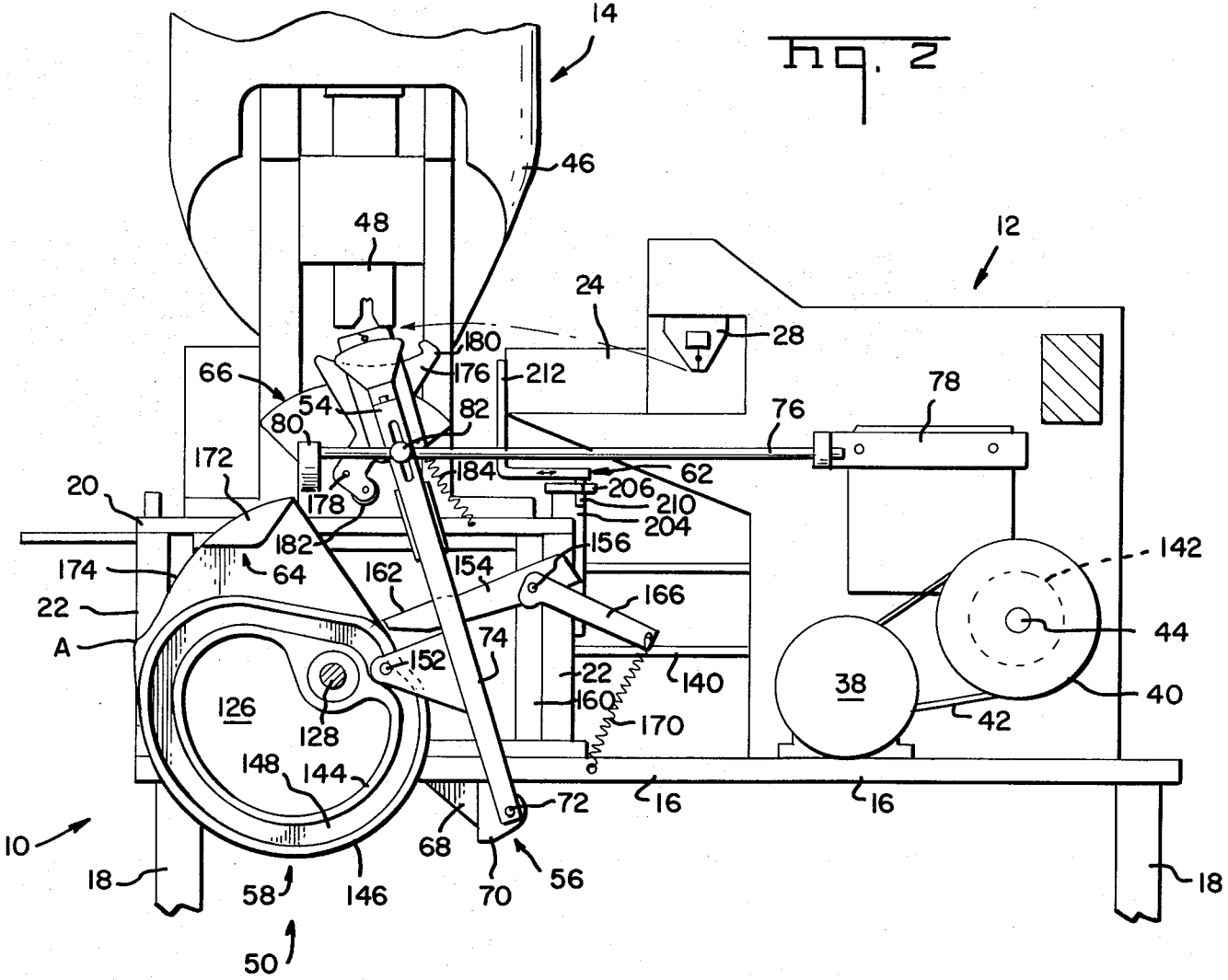
FIG. 2 is a view similar to FIG. 1 in which the lead engaging means carried by one end of the conveyor arm means is shown in its second position adjacent an applicator which is adapted to apply terminations to a cut and stripped end of a lead.
Figure 3:
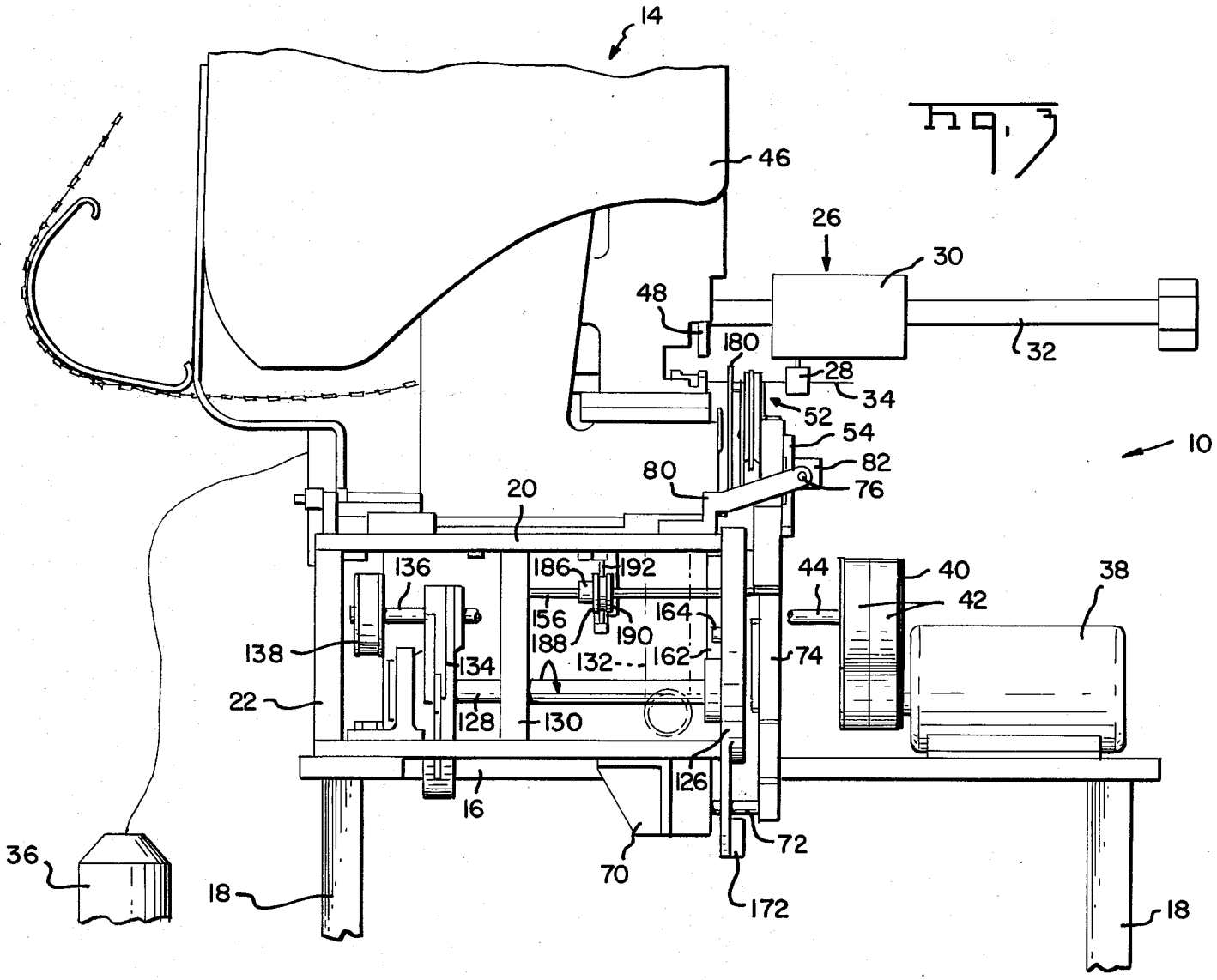
FIG. 3 is a left-hand end view of the apparatus shown in FIG. 1 and 2.

Referring first to FIGS. 1, 2, and 3, a frame, indicated generally at 10, supports a lead measuring, cutting, and stripping mechanism indicated generally at 12, and a termination applying applicator, indicated generally at 14, in spaced apart relationship with respect to each other. The frame includes a lower bench 16 supported by a plurality of legs 18, and an upper bench 20 supported by a plurality of frame members 22. The measuring, cutting and stripping mechanism 12 is mounted on the right-hand side of the lower bench 16 as can best be seen from FIGS. 1 and 2, and the termination applying applicator 14 is mounted on the upper bench 20.

The measuring, cutting and stripping mechanism is of a type commercially available and known as the Artos CS-6 which incorporates the principles of the machine shown in U.S. Pat. No. 2,680,394. The measuring, cutting and stripping mechanism includes a cutting and stripping station 24 which is disposed in its full line position shown in FIG. 1 when in the cutting and stripping mode, and which is disposed in the broken line position also shown in FIG. 1 when the lead is not being cut and stripped. The mechanism 12 further includes reciprocal feed means indicated generally at 26 (FIG. 3) which is operable during a cycle of reciprocation to feed a predetermined length of lead past the cutting and stripping station during each cycle of reciprocation. The feed means includes a feed clamp 28 which extends outwardly from a bracket 30 which is mounted for reciprocal movement upon rod means 32. During each cycle of operation of the measuring, cutting and stripping mechanism the bracket 30 will be moved from a left-hand position to a right-hand position while the lead clamp means engage a lead 34 to feed the lead past the cutting and stripping mechanism, and the lead clamp means will then open when the bracket means 30 attains its right-hand position and the bracket means will then be moved back to its left-hand position. The lead 34 which is to be cut, extends away from a source of supply 36. If the desired length of the lead is attained by a single reciprocal movement of the bracket 30 from the left to the right and back to the left, then the cutting and stripping mechanism is shifted from its open dotted line position in FIG. 1 to its closed position at the completion of the stroke of the bracket 30 to cut and strip the lead. However, if the desired length is not attained, the reciprocal feed means will cycle a number of times until the desired length of the lead is attained, at which point the cutting and stripping means will be caused to be operated. The measuring, cutting and stripping mechanism is caused to be driven from a motor 38 which is interconnected with a driven sheave 40 by a drive belt 42. The sheave 40 is mounted on a drive shaft 44 which is in turn interconnected with various of the operative components of the measuring, cutting and stripping mechanism in a manner not material to this invention.

The termination applying applicator 14 may include a terminal applicator of the type shown in U.S. Pat. No. 3,184,950, the terminal applicator being in turn mounted in a press of the type shown in U.S. Pat. No. 3,343,398. Obviously, other devices may be employed for applying terminals to the cut and stripped ends of the lead, or alternatively other termination devices may be employed in this combination. The applicator 14 may be driven from the drive shaft 44, or alternatively, it may be provided with its own internal drive means. When employing an applicator and a press of the type referred to in the Patents set forth above, internal drive means are provided, the internal drive means including a single revolution clutch mounted within the press 46, the single revolution clutch being adapted to move a portion of the press and the terminal applicator 48 between closed and open positions, the open position being shown in the various Figures. The single revolution clutch is caused to be engaged by electrical control means which insure that the applicator will only move downwardly when a lead is positioned below the applicator. The electrical control means will be described below.

Figure 6:
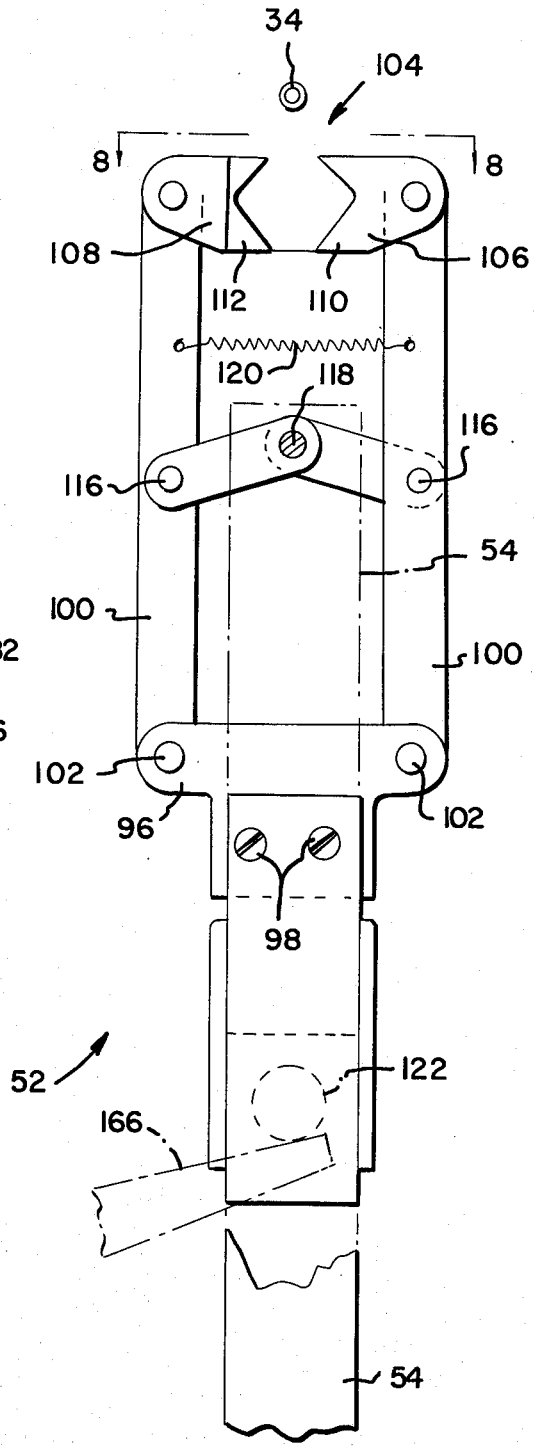
FIG. 6 is a side view of the structure shown in FIG. 5, the parts being disposed in their open position.
Figure 7:
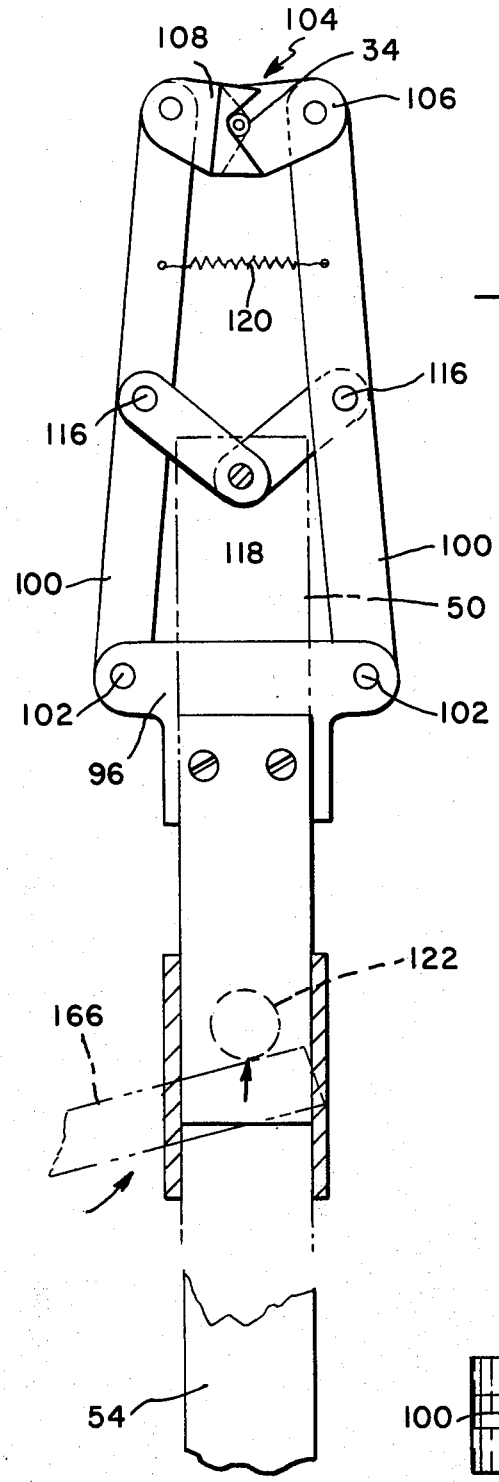
FIG. 7 is a view similar to FIG. 6, the parts being disposed in their closed position.
Figure 8:
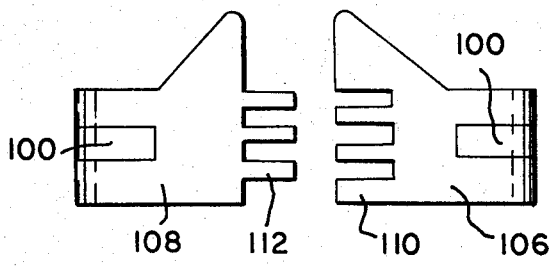
FIG. 8 is a view taken generally along the lines 8—8 in FIG. 6 showing the jaw means which are adapted to engage the lead to be transferred.

The lead transfer means, which is indicated generally at 50, includes lead engaging means indicated generally at 52, the lead engaging means being shiftable between an open position shown in FIG. 6 and a closed position shown in FIG. 7. The lead engaging means, which will be described in detail later, are mounted upon one end 54 of conveyor arm means, indicated generally at 56, the conveyor arm means being pivotally mounted on the frame 10. Rotary cam means, indicated generally at 58, is mounted on the frame and is interconnected with the conveyor arm means to swing the one end 54 between a first position adjacent the mechanism 12 and a second position adjacent the applicator 14. First shifting means, indicated generally at 60, is provided for normally shifting the lead engaging means from an open position to a closed position when the lead engaging means is disposed adjacent the mechanism 12. Means, indicated generally at 62, are provided to dispose the first shifting means in either an operative or an inoperative position, the first shifting means only being able to close the lead engaging means when it is in its operative position. Second shifting means, indicated generally at 64 is also provided for shifting the lead engaging means from the closed position to the open position when the one end 54 of the conveyor arm means is disposed adjacent the mechanism 12. Finally, the lead transfer means further includes ejector means, indicated generally at 66, the ejector means being disposed adjacent the applicator 14 and being operable to eject a cut and stripped lead from the applicator after a termination has been applied to the cut and stripped end. The various components of the lead transfer means will now be described in greater detail.

Figure 5:
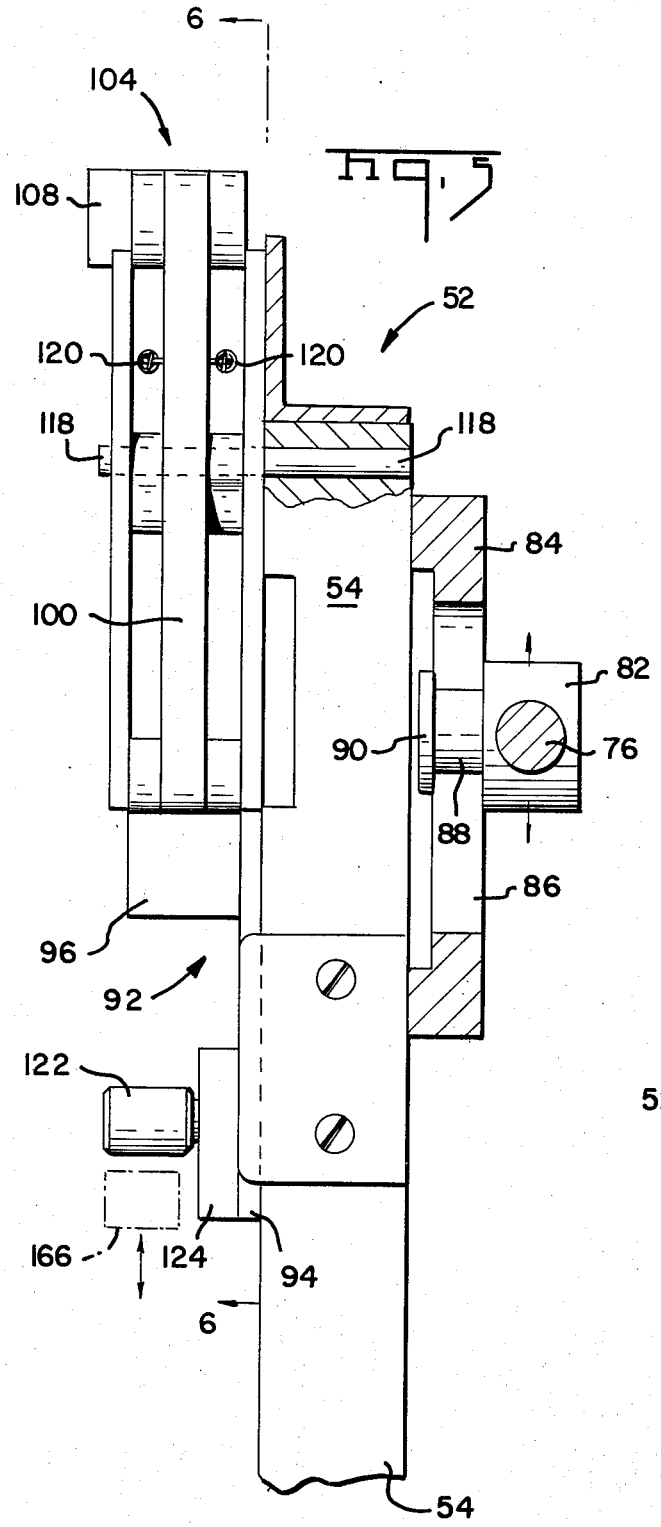
FIG. 5 is an enlarged side view taken from the left-hand end of the machine showing the lead engaging means carried by one end of the conveyor arm means.

The conveyor arm means 56 is interconnected with the frame 10 by means of a bracket 68, which is secured to the lower surface of the lower bench 16, the bracket 68 in turn carrying a bearing block 70 in which one end of a pivot shaft 72 is journalled. The other end of the pivot shaft 72 is received within an aperture (no number) in a conveyor arm 74. The one end 54 of the conveyor arm which is remote from the pivot shaft 72 carries the lead engaging means 52. The one end 54 is stabilized as it is swung from its first position shown in FIG. 1 to its second position shown in FIG. 2 by means of a stabilizing rod 76 which has one end rigidly secured to the mechanism 12 by means of a mounting bracket assembly 78, the other end of the stabilizing rod 76 being rigidly secured to the upper surface of the upper length 20 by means of a mounting bracket 80. A brass fitting 82 (FIG. 5) is journalled about the rod 76 for sliding movement, the brass fitting in turn being interconnected with a mounting member 84 which is secured to said one end 54 of the conveyor arm 74, the mounting member having an elongated slot 86. A cylindrical member 88 extends through the slot 86, the cylindrical member having one end rigidly secured to the brass fitting 82, and the other end being provided with an enlarged portion 90 which holds the brass fitting 82 adjacent the mounting member 84 as the fitting reciprocates upwardly and downwardly with respect to the slot 86 during the swinging of the end 54 from one position to the other.

The lead engaging means 52, which are mounted on the one end 54 of the conveyor arm 74, include a shiftable member assembly 92, the shiftable member assembly including a slide plate 94 and a pivot block 96 which is rigidly secured to the slide plate 94 by fasteners 98. As can best be seen from FIGS. 6 and 7, the shiftable member assembly is supported on the one end 54 of the conveyor arm 74 by a bracket 99 for movement between a first position shown in FIG. 6 and a second position shown in FIG. 7. A pair of elements 100 have one end pivotally secured to the pivot block 96 by pivot pins 102, the elements extending away from the conveyor arm means. The other end of the elements 100 carry jaw means 104, the jaw means including a right-hand jaw 106 and a left-hand jaw 108 which are provided with interengaging portions 110, 112 which have V-shaped surfaces which serve to closely engage a lead 34. A pair of links 114 are provided, one end of each of the links being pivotally interconnected by a pivot pin 116 to an intermediate portion of an associated element 100, and the other end of each of the links 114 being pivotally interconnected by means of a pivot pin 118 to the end 54 of the conveyor arm 74. Spring means 120 are provided, the spring means 120 being interconnected with the elements 100 and operable to bias the jaw means carried by the elements towards each other. As can be seen from a comparison of FIGS. 6 and 7, the links 114 pass through an over center position as the shiftable member assembly 92 is shifted between the first position shown in FIG. 6 to the second position shown in FIG. 7, and it can also be seen that the spring means will normally hold the elements 100 in either their open position or in their closed position. The lead engaging means 52 also includes a roller 122 which is secured to the slide member 94 by a mounting assembly 124.

The rotary cam means 58 includes a rotary cam element 126 mounted upon a drive shaft 128 which is in turn journalled at spaced apart locations by members 130 and 132, the members 130, 132 being interconnected with the lower bench 16. The end of the shaft 128 remote from the rotary cam element 126 is interconnected with the output shaft of a gear reduction box 134 which is mounted on the frame 10. The input shaft 136 of the gear reduction box carries a sheave 138. A drive belt 140 is disposed over the sheave 138 and also has a portion disposed over another sheave 142 which is interconnected with the drive shaft 44. The sheaves 138, 142, belt 140 and gear reduction box 134 are part of cam drive means which serve to rotate the rotary cam means one complete revolution for each cycle of reciprocation of the reciprocal feed means.

On one side of the rotary cam element spaced apart sidewalls 144, 146 are provided which define therebetween a cam track 148. The cam track 148 is in turn interconnected with the conveyor arm means 56. To this end, the conveyor arm means is provided with a bracket 150 which is secured to an intermediate portion of the conveyor arm 74, the bracket in turn supporting a roller (not shown) on a stub shaft 152, the roller riding within the cam track 148. As the rotary cam means progresses through a complete revolution, the end 54 of the conveyor arm 74 which carries the lead engaging means will be swung from a first position adjacent the cutting, stripping and measuring mechanism 12 to a second position adjacent the applicator 14 and then back to the first position adjacent the mechanism 12. During each complete revolution of the rotary cam means there will be sufficient dwell at one station or the other so that a cut and stripped lead can be either loaded onto the lead engaging means at the first station or discharged at the second station.

Figure 4:
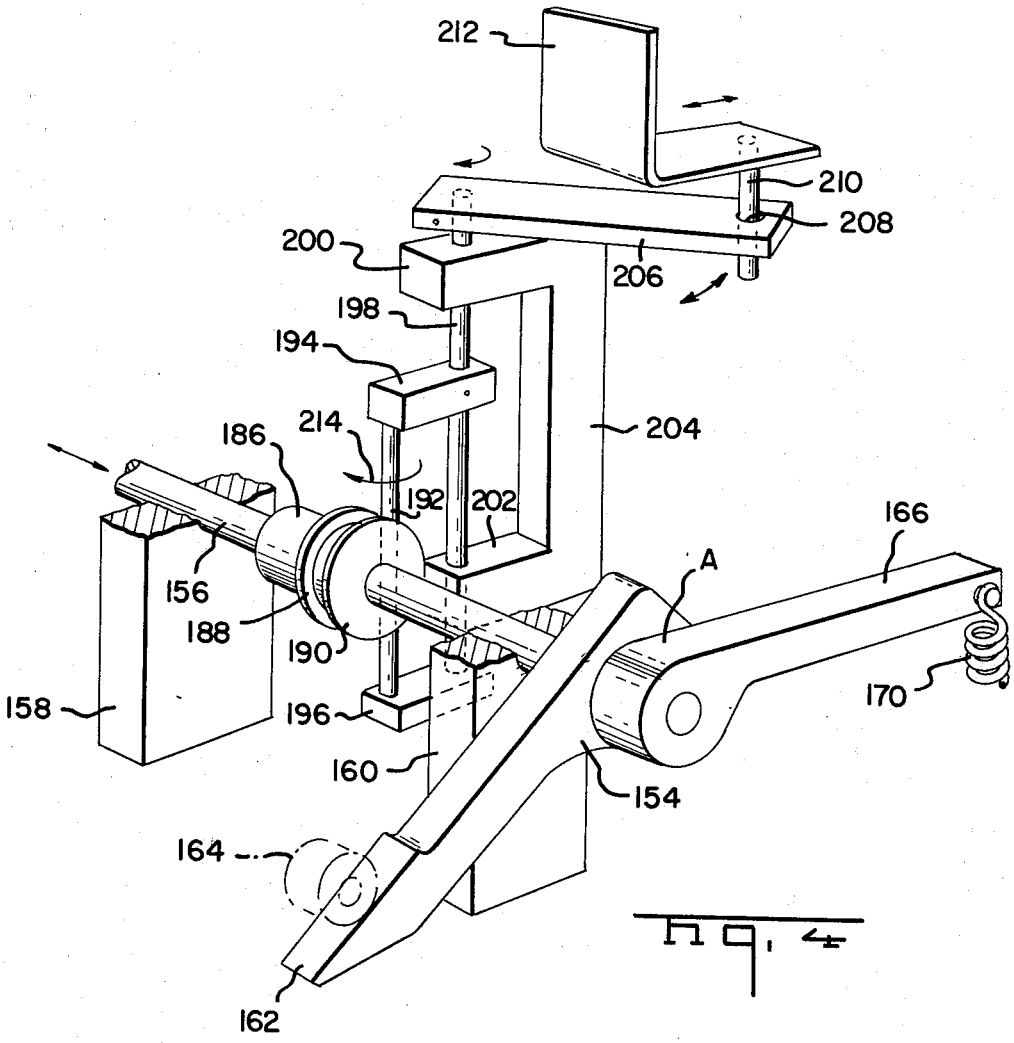
FIG. 4 is a somewhat schematic perspective view of the structure which disposes the shifting means in either an operative or inoperative position, the shifting means being in turn operable to normally shift the lead engaging means from an open position to a closed position when the shifting means is disposed in its operative position.

The first shifting means 60 which operates to shift the lead engaging means from their open position to their closed position when the one end 54 of the conveyor arm 74 is disposed adjacent to the measuring, cutting and stripping mechanism includes a bell crank lever 154 is shown in FIGS. 2 and 4. Means are provided for mounting an intermediate portion of the bell crank lever 154 on the frame for swinging movement between first and second positions, the mounting means including a pivot shaft 156 which is journalled for rotational and also for sliding movement on spaced apart mounting members 158, 160, the spaced apart mounting members being in turn interconnected with the frame 10 in a manner not material to the present invention. The bell crank lever includes a first surface 162 on one end of the bell crank lever means, the first surface being in turn engagable with a bell crank engaging cam lobe in the form of a roller 164, the roller being supported by the rotary cam element 126. Second surface means 166 is provided on the other end of the bell crank lever means and the second surface means 166 is in turn engagable with the roller 122 for shifting the lead engaging means from the open position to the closed position as the bell crank lever means is shifted in the direction of the arrow 168 from its normal first position shown in FIG. 1 to the second position shown in part in FIG. 7. Spring means 170 are provided, one end of the spring means being interconnected with that end of the bell crank lever mechanism which carries surface 166, and the other end of the spring means 170 being interconnected with the lower bench 16. The spring means 170 normally maintains the bell crank lever means in the first position shown in FIG. 1.

The rotary cam element 126 also carries the second shifting means 64 which is a cam lobe 172, the inner surface of which is engagable with the roller 122 when the end 54 of the conveyor arm 74 is in its second position to open the lead engaging means 52. The outer surface 174 of the rotary cam element 126 adjacent the cam lobe 172 is engagable with the ejector means 66 to cause a terminated lead to be ejected from the applicator 14. The ejector 66 includes a bell crank mechanism 176 which is pivotally supported on the frame 10 by a pivot shaft 178. One end of the bell crank mechanism 176 is provided with ejector structure 180, and the other end of the bell crank mechanism 176 is provided with a roller 182. A spring 184 which interconnects the bell crank mechanism 176 with the upper bench 20 normally biases the ejector to the position shown in FIG. 1. However, when the roller 122 is engaged by the ejector means engaging cam lobe or surface 174, the bell crank mechanism will be shifted in a counterclockwise direction as viewed in FIG. 1 to cause the ejector structure 180 to contact the terminated lead and eject it from the machine. The timing is such that when the cam lobe 172 contacts the roller 122 to open the lead engaging means 52 a portion of the press and the terminal applicator are in their lower positions thereby holding the lead. However, when the roller 182 is engaged by the surface 174 to cause the ejector 176 to eject the lead, the applicator 48 is then in its raised position.

As previously noted, means 62 are provided to dispose the first shifting means 60 in either an operative or an inoperative position. To this end, the shaft 156 which carries the bell crank lever 154 is journalled in the spaced apart mounting members 158, 160 for sliding movement. The shaft 156 is also provided with an element 186 which is provided with spaced apart flanges 188, 190 which define a channel therebetween. The means to dispose the shifting means in either its operative or its inoperative position includes a rod 192 which rides within the channel between the flanges 188, 190, the rod 192 in turn being interconnected to spaced apart brackets 194, 196 which are rigidly secured to a shaft 198. The shaft 198 is journalled for rotational movement in spaced apart legs 200, 202 of a U-shaped element 204 which is in turn rigidly mounted upon the frame 10 in a manner not material to the present invention. The upper end of the shaft 198 extends above the upper leg 200 and is rigidly interconnected to one end of a plate 206. The other end of the plate is provided with an aperture 208 through which a pin 210 extends, the pin 210 being in turn secured to an L-shaped bracket 212 which is mounted upon one side of the cutting and stripping station 24. When the cutting and stripping station is in its closed or operative position, the L-shaped bracket 212 will be disposed in a right-hand position as viewed in FIG. 4, and this will in turn cause the shaft 156 to be projected to the right which is its operative position. When the shaft 156 is in its operative position the first surface 162 of the bell crank 154 may be contacted by the roller 164 which will in turn cause the second surface 166 to engage the roller 122 to close the lead engaging means 52. However, when the cutting and stripping station is held in its open position shown in dotted lines in FIG. 1 the right-hand end of the plate 206 will be shifted to the left from the position shown in FIG. 4 which will in turn cause the rod 192 to move in the direction of the arrow 214 to shift the shaft 156 in a left-hand direction. When the shaft 156 has been shifted to its left-hand position the bell crank 154 will be so disposed with respect to the roller 164 that the roller will pass to the right of the surface 162. When this condition happens, it should be apparent that the bell crank 154 will not be rotated in the direction of the arrow 168 and therefore the lead engaging means will not be closed.

OPERATION

The operation of the lead transfer mechanism should be apparent from the above detailed description. However, it should be noted that various cam surfaces carried by the rotary cam element are so timed with respect to each other and to the lead measuring, cutting and stripping mechanism that the various desired operations take place at suitable times. Thus, when measuring a lead with only a single stroke of the reciprocal feed means, the cutting and stripping station 24 will be shifted from its dotted line to its full line position shown in FIG. 1 at the completion of the stroke to cut and strip the trailing end of the lead. At this time the first surface 162 of the bell crank lever 154 will be engaged by the roller 164 to shift the bell crank lever 154 in the direction of the arrow 168 to close the lead engaging means 52, the lead engaging means being closed as the shiftable member assembly 92 shifts from the position shown in FIGS. 5 and 6 to the position shown in FIG. 7. Further rotational movement of the rotary cam member 126 will then cause the end 54 of the conveyor arm 74 to be swung from its first position shown in FIG. 1 to its second position shown in FIG. 2. After the conveyor has attained its second position shown in FIG. 2 the cam lobe 172 will then cause the lead engaging means to be opened. At this time it should be noted that the press and applicator will be in their lower position. The press and applicator are caused to be operated by a pair of micro-switches which are in series with each other, one microswitch sensing the position of the cutting and stripping station and the other micro-switch sensing the position of the conveyor arm 74. When the cutting and stripping is in its operative full line position shown in FIG. 1 a first micro-switch will be closed and when the conveyor arm 74 is in its second position a second micro-switch will be closed to complete a circuit. The completion of the circuit will in turn cause a single revolution clutch in the press mechanism to reciprocate the applicator 48 downwardly and then upwardly. After the applicator 48 has shifted upwardly the cam surface 174 will then contact the roller 182 to cause the terminated lead to be ejected.

In the event that a multiple stroke feed is utilized for measuring the lead, it should be observed that the cutting and stripping station will be maintained in its dotted line position shown in FIG. 1 until the reciprocal feed means has cycled the desired number of times. However, during each cycle of operation of the reciprocal feed means, the rotary cam means will complete one revolution. While the cutting and stripping station is maintained in its open dotted line position the bell crank lever 154 will be maintained in an inoperative position, and therefore the lead engaging means will not engage a lead during swinging motion of the end 54 of the conveyor arm from its first position to its second position until the cutting and stripping station has shifted to its full line position. Also, the press means will not be operated as the micro-switch at stations 24 will remain open thus preventing the circuit from being completed to initiate the operation of the single revolution clutch within the press.

While a preferred structure in which the principles of the present invention have been incorporated are shown and described above, it is to be understood that this invention is not to be limited to the particular details, shown and described above, but that, in fact, widely differing means may be employed in the practice of the broader aspects of this invention.

We claim:

1. In an automatic lead processing apparatus including a frame;

a mechanism mounted on said frame and operable to feed a predetermined length of lead from a lead supply, and to cut and strip the lead after feeding; and an applicator mounted on said frame at a location spaced away from said mechanism and operable to apply a termination to the cut and stripped end of the lead;

the combination therewith of a lead transfer mechanism including:

lead engaging means shiftable between a closed engaging position and an open position where it is capable of either receiving or discharging a lead;

conveyor arm means pivotally mounted on said frame, one end of said conveyor arm means carrying said lead engaging means;

rotary cam means rotatably mounted on said frame and interconnected with said conveyor arm means and operable upon rotation of said cam means to swing said one end of the conveyor arm means between a first position adjacent said mechanism and a second position adjacent said applicator; and shifting means for normally shifting the lead engaging means between closed and open positions in timed sequence to the movement of the conveyor arm means, causing said lead engaging means to receive and engage a lead when said one end of said conveyor arm means is in the first position, to hold the lead as said one end of the conveyor arm means is moved from the first position to the second position, and to open the lead engaging means when said one end of the conveyor arm means is in the second position;

said shifting means including first shiftable means for normally shifting the lead engaging means from its open position to its closed position when said one end of the conveyor arm means is disposed in its first position.

2. The apparatus set forth in claim 1 in which said shifting means includes second shifting means operable to shift the lead engaging means from its closed position to its open position when said one end of the conveyor arm means is disposed in its second position.

3. The apparatus set forth in claim 2 in which the second shifting means is a cam lobe interconnected with said rotary cam means.

4. In an automatic lead processing apparatus including a frame;

a mechanism mounted on said frame and operable to feed a predetermined length of lead from a lead supply, and to cut and strip the lead after feeding; and an applicator mounted on said frame at a location spaced away from said mechanism and operable to apply a termination to a cut and stripped end of the lead;

the combination therewith of a lead transfer mechanism including:

lead engaging means shiftable between a closed engaging position and an open position where it is capable of either receiving or discharging a lead;

conveyor arm means pivotally mounted on said frame, one end of said conveyor arm means carrying said lead engaging means;

rotary cam means rotatably mounted on said frame and interconnected with said conveyor arm means and operable upon rotation of said cam means to swing said one end of the conveyor arm means between a first position adjacent said mechanism and a second position adjacent said applicator; and shifting means for normally shifting the lead engaging means between closed and open positions in timed sequence to the movement of the conveyor arm means, causing said lead engaging means to receive and engage a lead when said one end of said conveyor arm means is in the first position, to hold the lead as said one end of the conveyor arm means is moved from the first position to the second position, and to open the lead engaging means when said one end of the conveyor arm means is in the second position;

said shifting means including first shiftable means for normally shifting the lead engaging means from their open to their closed positions when said one end of the conveyor arm means is disposed in its first position; and second cam means operatively engageable with said first shifting means for causing the first shifting means to move the lead engaging means from its open position to its closed position, said second cam means being interconnected with said rotary cam means, said rotary cam means including cam track means interconnected with the conveyor arm means, and said second cam means including a cam lobe mounted upon said rotary cam means.

5. In an automatic lead processing apparatus including a frame;

a mechanism mounted on said frame and operable to feed a predetermined length of lead from a lead supply, and to cut and strip the lead after feeding; and an applicator mounted on said frame at a location spaced away from said mechanism and operable to apply a termination to a cut and stripped end of the lead;

the combination therewith of a lead transfer mechanism including:

lead engaging means shiftable between a closed lead engaging position and an open position where it is capable of either receiving or discharging a lead;

conveyor arm means pivotally mounted on said frame, one end of said conveyor arm means carrying said lead engaging means;

rotary cam means rotatably mounted on said frame, said conveyor arm means interconnected with said cam means and operable upon rotation of said cam means to swing said one end of the conveyor arm means between a first position adjacent said mechanism and a second position adjacent said applicator; and shifting means for normally shifting the lead engaging means between closed and open positions in timed sequence to the movement of the conveyor arm means, causing said lead engaging means to receive and engage a lead when said one end of said conveyor arm means is in the first position, to hold the lead as said one end of the conveyor arm means is moved from the first position to the second position, and to open the lead engaging means when said one end of the conveyor arm means is in the second position; and said lead engaging means including a shiftable member supported by the one end of said conveyor arm means for shiftable movement between first and second positions, a pair of elements carried by said shiftable member and extending away from said conveyor arm means, each of said elements being provided with jaw means on the outer end thereof, a pair of links, one end of each of the links being pivotally interconnected to a respective intermediate portion of one of said elements, and the other end of each of the links being pivotally interconnected to the one end of said conveyor arm means, said pair of links passing through an over center position as the shiftable member is shifted between said first and second positions, and spring means interconnecting said elements and operable to hold the elements either in their open positions when the shiftable member is in the first position or in their closed positions when the shiftable member is in the second position.

6. The apparatus set forth in claim 5 in which said shifting means includes first shifting means for shifting the lead engaging means from its open position to its closed position, said first shifting means including bell crank lever means mounted upon said frame for swinging movement between first and second positions, spring means operable to normally hold the bell crank lever means in the first position, bell crank engaging cam lobe means mounted on said rotary cam means and operable to engage first surface means on one end of the bell crank lever means to cause said bell crank lever means to be moved from its first position to its second position during rotation of said rotary cam means, and second surface means on the other end of the bell crank lever means engagable with said shiftable member to shift the shiftable member between its first and second position as the bell crank lever means is shifted between first and second positions.

7. The apparatus set forth in claim 6 in which said applicator is shiftable between open and closed positions for applying terminations to the end of a lead, and in which said shifting means includes second shifting means for shifting the lead engaging means from its closed position to its open position, said second shiftable means being cam lobe means mounted on the rotary cam means operable to engage and open the lead engaging means when the conveyor arm means is in its second position and the applicator is in its closed position.

8. The apparatus set forth in claim 7 further characterized by the provision of ejector means swingably mounted on said frame adjacent said applicator and further characterized by the provision of means engaging cam lobe means on the rotary cam means operable to engage and swing the ejector means from a first position to a second position to eject a terminated lead after the lead engaging means has been opened by the second shiftable means and the applicator has moved to its open position.

9. An automatic lead processing apparatus comprising:

a frame;

a mechanism mounted on said frame, said mechanism including a cutting and stripping station and reciprocal feed means operable to feed a predetermined length of lead from a lead supply past the cutting and stripping station during each cycle of reciprocation, the cutting and stripping station being operated to subsequently cut and strip the lead only after the desired number of predetermined lengths of the lead have been fed past the cutting and stripping station;

an applicator mounted on the frame at a location spaced away from said mechanism and operable to apply a termination to the cut and stripped end of the lead;

lead engaging means shiftable between a closed lead engaging position and an open position where it is capable of either receiving or discharging a lead;

conveyor arm means pivotally mounted on said frame, one end of said conveyor arm means carrying said lead engaging means;

rotary cam means rotatably mounted on said frame and interconnected with said conveyor arm means, said rotary cam means being operable upon rotation thereof to swing said one end of the conveyor arm means between a first position adjacent said mechanism and a second position adjacent said applicator;

cam drive means interconnecting said rotary cam means with said mechanism for rotating said rotary cam means a complete revolution upon each cycle of reciprocation of the reciprocal feed means; and shifting means for normally shifting the lead engaging means between closed and open positions in timed sequence to the movement of the conveyor arm means causing said lead engaging means to receive and engage a lead when said one end of the conveyor arm means is in the first position, to hold the lead as said one end of the conveyor arm means is moved from the first position to the second position, and to open the lead engaging means when said one end of the conveyor arm means is in the second position;

said shifting means including first shiftable means for normally shifting the lead engaging means from its open to its closed position when said one end of the conveyor arm means is disposed in its first position, means to dispose the first shiftable means in either an operative position or an inoperative position, the lead engaging means being maintained in its open position when the shiftable means is in its inoperative position, the parts being so arranged and constructed that the reciprocal feed means may feed a plurality of predetermined lengths of lead from the lead supply past the cutting and stripping station during a plurality of cycles of reciprocation of the reciprocal feed means before the lead is cut and stripped, and said first shifting means may be maintained in an inoperative position until the lead is cut and stripped whereby the conveyor arm means may be moved between its first and second positions during each cycle of reciprocation without the lead engaging means engaging a lead except when a lead is cut and stripped.

10. An automatic lead processing apparatus comprising:

a frame;

a mechanism mounted on said frame, said mechanism including a cutting and stripping station and reciprocal feed means operable to feed a predetermined length of lead from a lead supply past the cutting and stripping station during each cycle of reciprocation, the cutting and stripping station being operated to subsequently cut and strip the lead only after the desired number of predetermined lengths of the lead have been fed past the cutting and stripping station;

an applicator mounted on the frame at a location spaced away from said mechanism and operable to apply a termination to the cut and stripped end of the lead;

lead engaging means shiftable between a closed lead engaging position and an open position where it is capable of either receiving or discharging a lead;

conveyor arm means pivotally mounted on said frame, one end of said conveyor arm means carrying said lead engaging means;

rotary cam means rotatably mounted on said frame and interconnected with said conveyor arm means, said rotary cam means being operable upon rotation to swing said one end of the conveyor arm means between a first position adjacent said mechanism and a second position adjacent said applicator;

cam drive means interconnecting said rotary cam means with said mechanism and operable to rotate said rotary cam means a complete revolution upon each cycle of reciprocation of the reciprocal feed means; and shifting means for normally shifting the lead engaging means between closed and open positions in timed sequence to the movement of the conveyor arm means causing said lead engaging means to receive and engage a lead when said one end of the conveyor arm means is in the first position, to hold the lead as said one end of the conveyor arm means is moved from the first position to the second position, and to open the lead engaging means when said one end of the conveyor arm means is in the second position;

said shifting means including first shiftable means for normally shifting the lead engaging means from its open position to its closed position when said one end of the conveyor arm means is disposed in its first position, said first shiftable means including bell crank lever means, means mounting an intermediate portion of said bell crank lever means upon said frame for swinging movement between first and second positions, bell crank engaging cam lobe means carried by said rotary cam means and operable to engage first surface means on one end of said bell crank lever means to cause the bell crank lever means to be moved between its first and second positions during rotation of said rotary cam means, and second surface means on the other end of the bell crank lever means engageable with said lead engaging means to cause said lead engaging means to be moved from its open position to its closed position as said bell crank lever means is moved from its first position to its second position.

11. The apparatus set forth in claim 10 further characterized by the provision of means to dispose the bell crank lever means in either an operative or an inoperative position, the lead engaging means being maintained in its open position when the bell crank lever means is in its inoperative position during a complete revolution of the rotary cam means, the part being so arranged and constructed that the conveyor arm means may swing between the first and second positions without engaging a lead as the reciprocal feed means is cycled without a corresponding cutting and stripping of a lead.

12. The apparatus set forth in claim 11 wherein the means to dispose the bell crank lever means in either an operative position or an inoperative position is operatively interconnected with the cutting and stripping station in such a manner that the bell crank lever means will be disposed in its operative position only when the cutting and stripping station means is operated.

13. The apparatus set forth in claim 11 wherein said means mounting an intermediate portion of the bell crank lever means includes a pivot shaft secured to the bell crank lever means, and means journalling the pivot shaft for both rotational movement and longitudinal shifting movement on said frame; and wherein the means to dispose the bell crank lever means in either an operative or an inoperative position includes flange means carried by said pivot shaft, and means interconnecting the flange means with the cutting and stripping station to cause the bell crank lever means to be disposed in an operative position during operation of the cutting and stripping station and to be disposed in an inoperative position when the cutting and stripping station is not operated.

14. A machine for tranferring electrical leads individually from a first work station to a second work station, comprising:

a frame, an arm mounted for reciprocation on said frame, a single rotary cam mounted for rotation on said frame and operative in a complete cycle of revolution to first maintain momentarily said arm at a first work station, then reciprocate said arm to a second work station, then maintain momentarily said arm at said second work station and then reciprocate said arm to said first work station, a set of jaws on said arm and operative to a closed together position into gripped relation on a lead supplied at said first work station and operative apart to an open position for releasing said lead at said second work station, ejecting means at said second work station for removing said lead when released by said jaws, a first auxiliary cam portion on said single rotary cam for camming said jaws to a closed together position while said arm is maintained by said single rotary cam at said first work station, said jaws remaining closed together in gripped relation on said lead as said arm is pivoted by said single rotary cam from said first work station to said second work station thereby transferring said lead to said second work station, a second auxiliary cam portion on said single rotary cam for camming said jaws apart to an open position while said arm is maintained at said second work station prior to reciprocation of said arm to said first work station, and a fourth cam portion on said single rotary cam for actuating said ejectment means thereby removing said lead from the open apart jaws at said second work station.

15. The structure as recited in claim 14 and further including:

lead supplying means at said first work station, and an electrical contact applicator at said second work station, first actuating means connecting said single rotary cam with said supplying means to actuate said single rotary cam in one complete cycle of revolution upon supply of said electrical lead at said first work station at a time prior to closing together said jaws, and second actuating means connecting said applicator with said single rotary cam to actuate said applicator and thereby crimp an electrical contact onto said electrical lead while said arm is maintained at said second work station prior to opening apart said jaws at said second work station.

16. The structure as recited in claim 15 and further including:

crank means operatively connecting said first auxiliary cam portion and said jaws whereby said crank means is pivoted by said first auxiliary cam portion to close together said jaws, and said crank means being selectively disengageable from said first auxiliary cam portion to prevent closing together of said jaws while said lead supplying means supplies said electrical lead at said first work station.

17. The structure as recited in claim 14 wherein, said jaws further include a slide element slidably mounted on said arm together with elongated link elements pivotally connecting said jaws and said slide element, and further including:

a pair of links connected pivotally to a common location on said arm, said links extending outwardly from each other and being pivotally connected to respective link elements, a cam follower on said slide element, a lever pivotally mounted on said frame, said first auxiliary cam surface engaging and pivoting said lever into engagement with said cam follower to slide said slide element in a first direction to pivot said links toward each other thereby closing together said jaws, and said second auxiliary cam surface engaging said cam follower to slide said slide element in a second direction to pivot the links away from each other thereby opening apart said jaws.

* * * * *

UNITED STATES PATENT OFFICE

CERTIFICATE OF CORRECTION

PATENT NO. : 3,968,548

DATED : July 13, 1976

INVENTOR(S) : DONALD GEORGE CLARK & IVAN GODFREY OLIVER BROWN

It is certified that error appears in the above-identified patent and that said Letters Patent are hereby corrected as shown below:

Column 14, Claim 14, line 39 "fourth" should be ---third---.

Signed and Sealed this

Ninth Day of November 1976

[SEAL]

*Attest:*

RUTH C. MASON
*Attesting Officer*

C. MARSHALL DANN
*Commissioner of Patents and Trademarks*